US005809874A

United States Patent [19]

Kim

[11] Patent Number: 5,809,874

[45] Date of Patent: Sep. 22, 1998

[54] ROTARY BOOKRACK

[76] Inventor: Bongki Kim, O-yang, Daeyon Yangji Apt. 2-407, 1536-12, Daeyon 6 dong, Namku, Pusan, Rep. of Korea

[21] Appl. No.: 746,125

[22] Filed: Nov. 6, 1996

[51] Int. Cl.[6] ..... A47B 65/00

[52] U.S. Cl. ..... 211/42; 211/164; 108/22

[58] Field of Search ..... 211/42, 164, 144; 108/22

[56] References Cited

U.S. PATENT DOCUMENTS

| | | | |
|---|---|---|---|
| 45,521 | 12/1864 | Price | 211/164 X |
| 2,127,555 | 8/1938 | Devoire | 211/164 X |
| 5,269,232 | 12/1993 | De Lasada | 211/164 X |

FOREIGN PATENT DOCUMENTS

| | | | |
|---|---|---|---|
| 904801 | 11/1945 | France | 211/164 |
| 1168328 | 12/1958 | France | 211/164 |
| 317196 | 8/1929 | United Kingdom | 211/164 |

*Primary Examiner*—Jose V. Chen

*Attorney, Agent, or Firm*—Notaro & Michalos PC

[57] ABSTRACT

A rotary book rack arrangement has a stand and a stable plate fixed to and extending upwardly from the stand. The stable plate has a circular groove on one side. A rotating plate is mounted for rotation to the stable plate. Multiple book racks are connected for rotation to the rotating plate. A lower pin is fixed to each book rack and extends into the circular groove for riding in said circular groove with rotation of said rotating plate. An upper pin mounts the racks to the plate and a line between the upper and lower pins for each book rack is always vertical. A motor rotates the rotating plate.

3 Claims, 5 Drawing Sheets

ROTARY BOOKRACK

BACKGROUND OF THE INVENTION

1. Field of the Invention

The present invention relates to a rotary bookrack.

2. Discussion of Related Art

Generally, the bookrack is that a front portion thereof is open and various steps of shelves are fixed in a body of a box type. However, it is difficult for persons of small stature or children to arrange books or take books out of a high position thereof because of a high height of the bookrack.

Accordingly, there are disadvantages that a chair or table is required to arrange or take books out of the high position, a general bookrack is too simple and uniform, such that the atmosphere of an interior is dull.

SUMMARY OF THE INVENTION

The present invention is devised to provide a rotary bookrack which can be arranged or taken books out of a high position thereof at the state of sitting on the chair, given a beauty different from a conventional bookrack.

Accordingly, it is an object of the present invention to provide a rotary bookrack which can be arranged or taken books out of a high position thereof at the state of sitting on the chair, which can be maintained in a horizontal state according as the rotary bookrack that a plurality of bookracks are fixed on a rotative plate rotates while the rotative plate rotates in clockwise or counterclockwise, and given a beauty by removing an idea of a bookrack.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of drawings:

In the drawing

DETAILED DESCRIPTION OF PREFERRED EMBODIMENT

Figure 1:
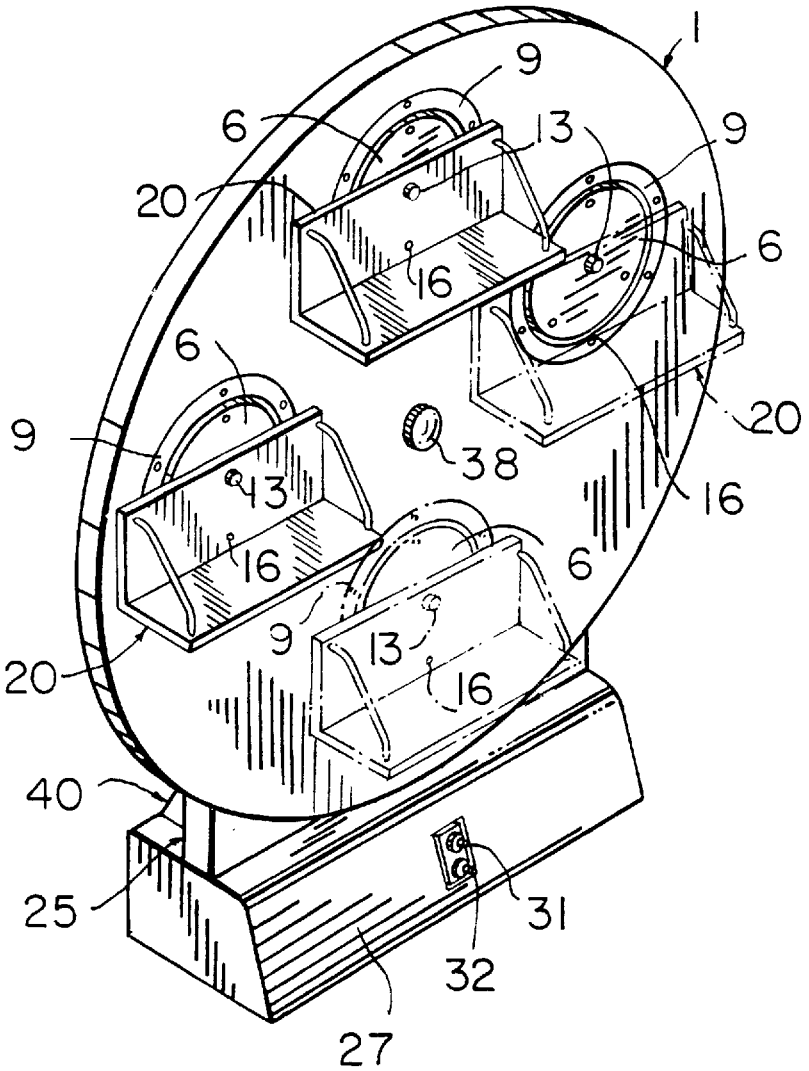
FIG. 1 is a perspective of the present invention.
Figure 2:
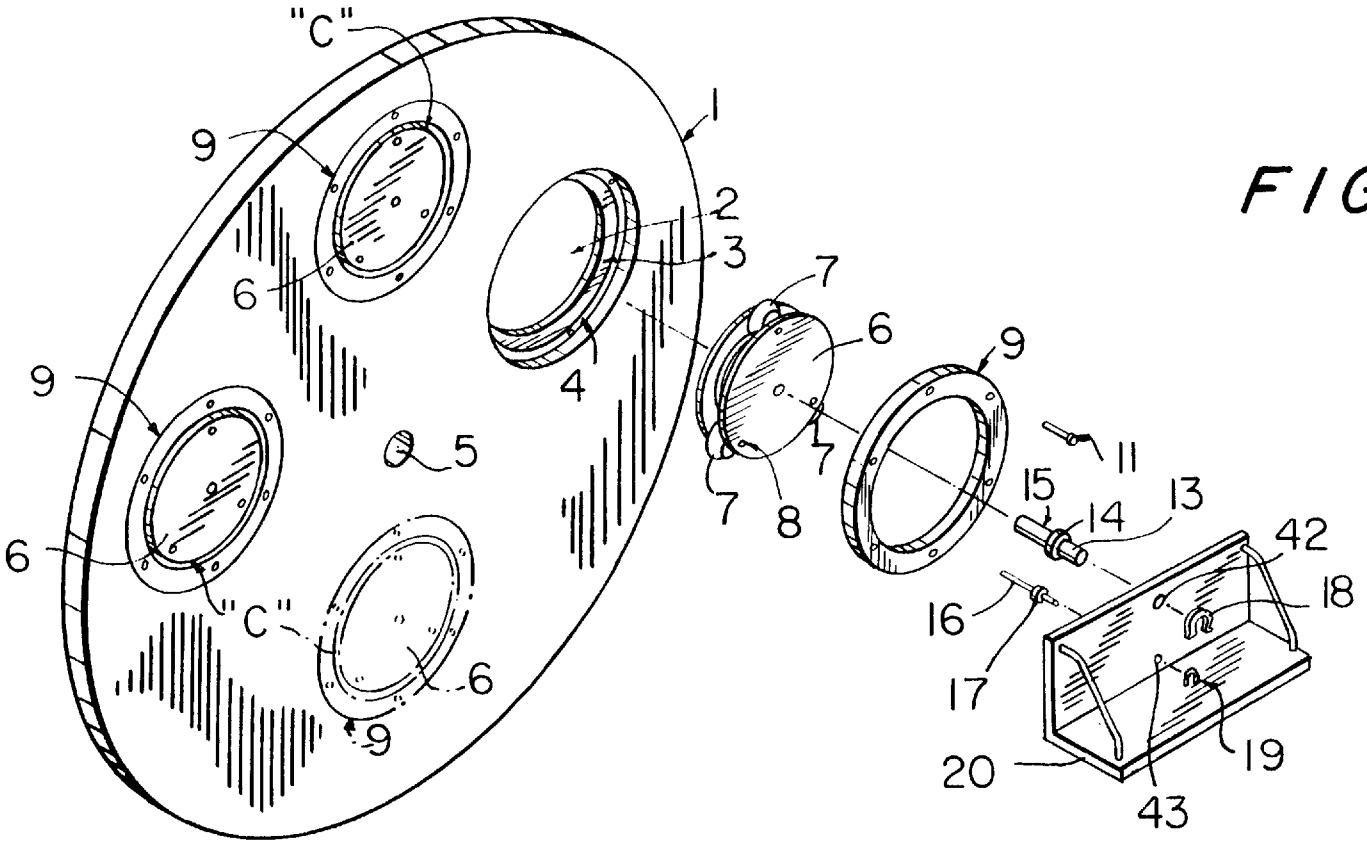
FIGS. 2 and 3 are disassembled perspective views of the present invention.
Figure 3:
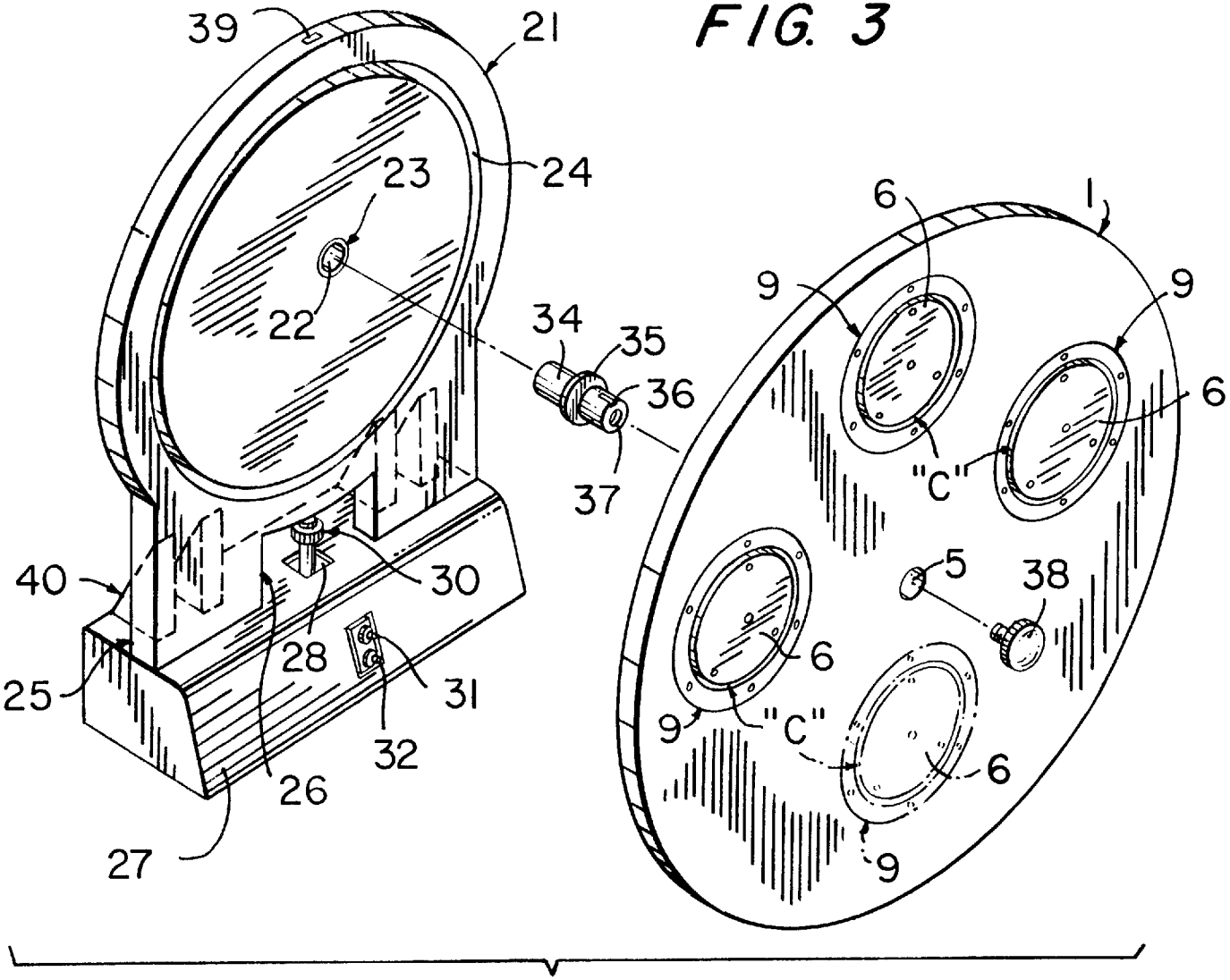
Figure 4:
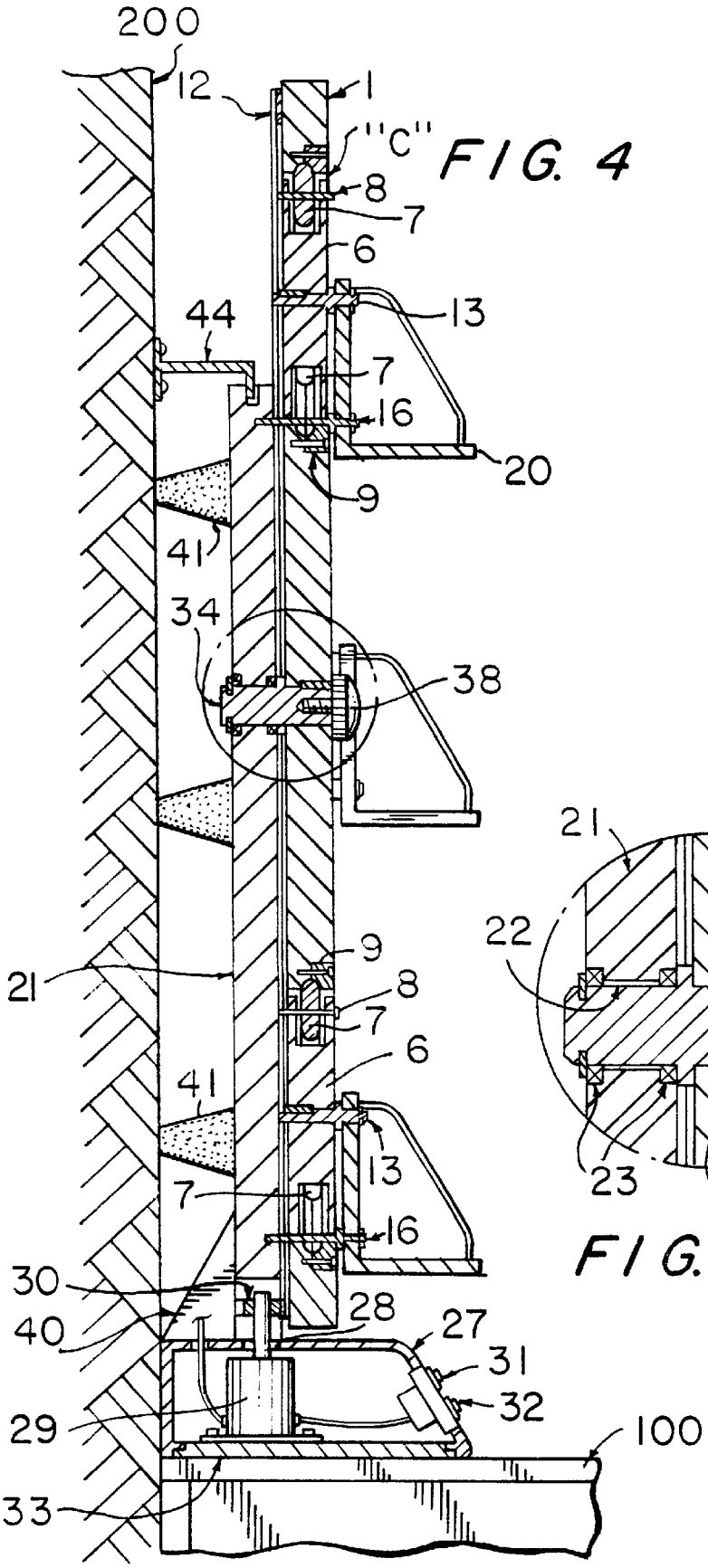
FIG. 4 is sectional view of the present invention.
Figure 4A:
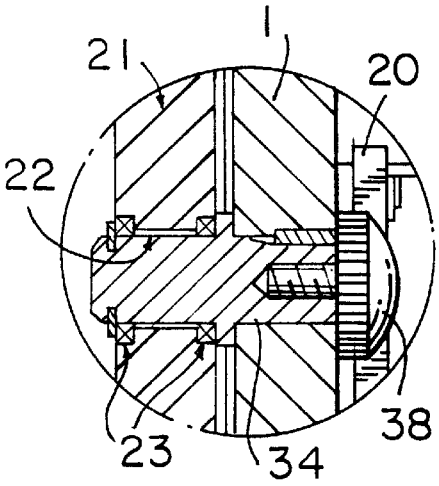
Figure 5:
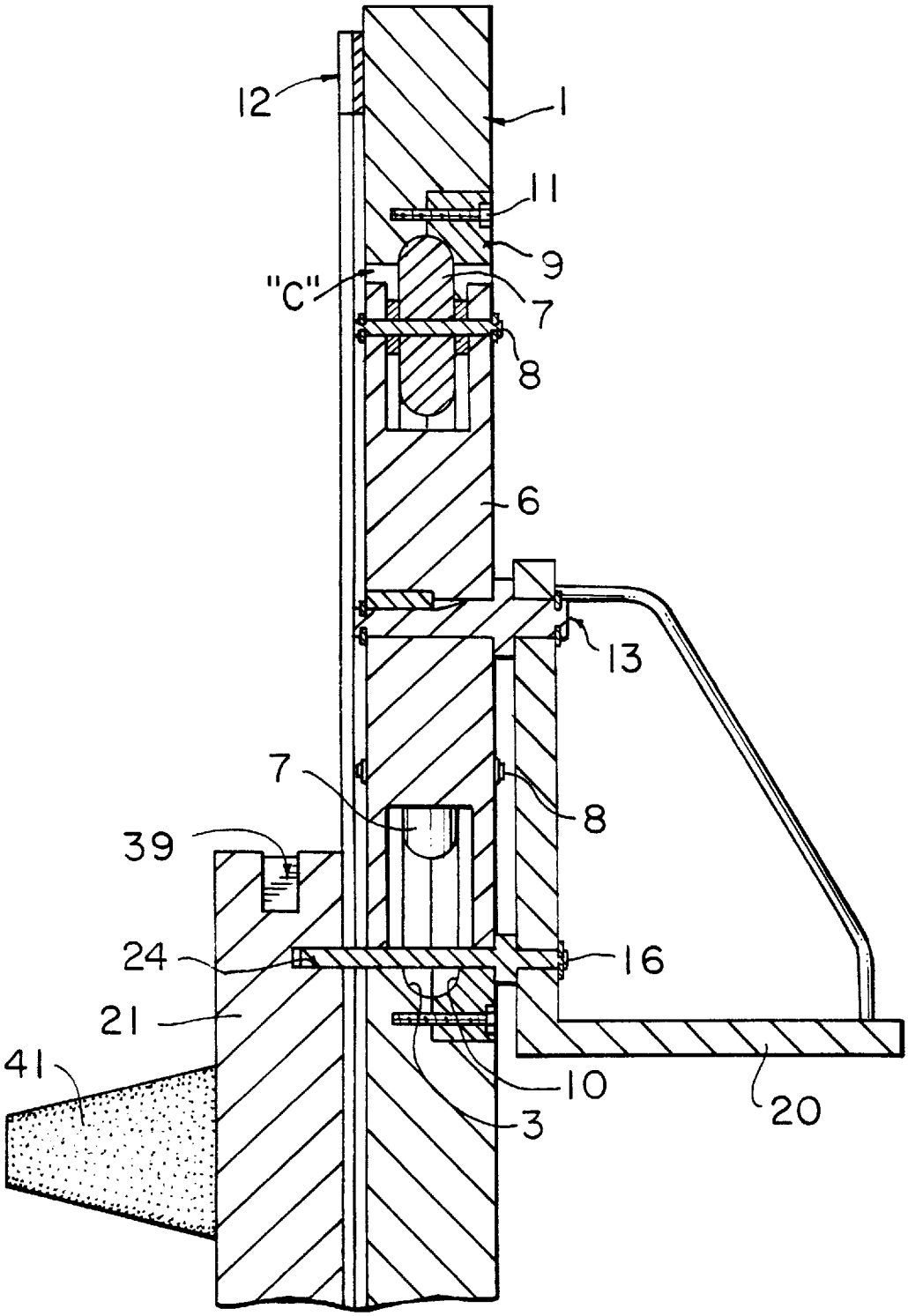
FIG. 5 is a fragmentary enlarged sectional view of the present invention.

Reference will now be made in detail to the preferred embodiments of the present invention, examples of which are illustrated in the accompanying drawings.

If actuating switches 31, 32 selecting a clockwise or counterclockwise are operated, a reducing motor is actuated and a pinion is rotated, a rotating plate 1 is rotated in one direction by a ring gear 12 in engaged therewith. When the rotating plate 1 is rotated, a bookrack is rotated of itself in the direction similar to that of the plate 1.

Even though books aren't put on the rack, the bookrack is rotated, maintained in the horizontal state in itself, supported by a pin 13.

However, since the rotary bookrack is put books at the right or left or whole thereof on the basis of the central thereof, in case that it loses its of a balance of a weight, it is natural for the bookrack to decline in the right or left side.

For the reason, it is not prepared for an enough requirement as a good because it is unstable and not beautiful.

Accordingly, the present invention is devised to solve problems described above, that is, even though the right doesn't equal to the left for a balance of a weight, the invention is to be able to rotate the bookrack with maintaining a horizontal state by the construction of a circular groove 24 of a stable plate 21 and a pin 16 inserted below the bookrack.

That is, in case that the bookrack moves, rotating with the rotative plate 1 at the degree of 360, the pin 16 also rotates at the degree of 360.

The trace of a wheel is formed (in case of without books in the rack) according to rotating a wheel of the pin 16, the trace corresponds to the circular groove 24 of the stable plate 21.

Therefore, the bookrack is forced to maintain the horizontal state according as the vertical centre of the up and down pins 13,16 is positioned on a vertical line, simultaneously moving according to the circular groove 24 of the stable plate 21.

The reason of above is that the pin 16 is inserted into the circular groove 24 of the stable plate 21 while drawing the trace of a circular according to the circular groove 24, however, the pin 16 doesn't move in the right and left in the groove 24 under the stopping state of the pin 16.

Accordingly, it is such important that the bookrack can be maintained in the horizontal direction according as the pins 13,16 are positioned on a vertical line while the pin 16 moves rotating according to the circular groove 24 of the stable plate 21 if the rotative plate 1 is rotated. The pin 16 maintains the bookrack in the horizontal, rotating according to the circular groove 24. When the rotative plate 1 rotates in counterclockwise on the basis of FIG. 1, if the highest of the bookrack is to be positioned in the original state after rotating a round, the pin 16 is rotated at the degree of 360 in counterclockwise according to the circular groove 24 of the stable plate 21, to the contrary, an isolated part c is rotated at the degree of 360 in clockwise on the basis of a rotative plate 6.

The reason of above is that when the pin 16 rotates in counterclockwise according to the circular groove 24, because the bookrack is always maintained in the horizontal while rotating in counterclockwise, at the last, the up and down pins 13, 16 can be maintained in a vertical line under the condition that the pin 16 must move up in clockwise within the isolated part c.

Therefore, the isolated part c that the rotative plates 1, 6 form isn't, the present invention can not be embodied if the plate 6 isn't formed to rotate. At this time, the rotative plate 6 turns on its axis at the degree of 360 in a hole 2 of the rotative plate 1. Since the pin 16 is moved, positioning between rollers 7, it is prevented by the rollers.

As described above, the bookrack of the present invention has an effect that can arrange or take books out of a high position thereof at the sitting state, because it is maintained in the horizontal at any position, not limited in moving according as the rotative plate 1 rotates.

Additionally, the present invention has an industrial effect that the rotary bookrack can be installed on the desk and keep a lot of books by positioning a support stand on the bottom if a plurality of bookracks are fixed by extending the diameter of the rotative plate 1 and can be used manually without a reducing motor, and can be used as a display stand of various kinds of goods, a kind of plaything, and an industrial instrument not limited in the usage of a bookrack.

What is claimed is:

1. A rotary book rack arrangement comprising;

a stand (27);

a stable plate (21) fixed to and extending upwardly from said stand, said stable plate having a circular groove (24) on one side thereof said circular groove having a first center;

a rotating plate (1) mounted for rotation about a second center to said stable plate, said second center being above said first center by a vertical distance;

said rotating plate (1) having a plurality of circumferentially-spaced openings (2) spaced around said second center;

a rotative plate (6) mounted for rotation in each of said openings (2) and defining a circular gap (c) between each rotative plate (6) and said rotating plate (1);

a book rack (20) connected to each rotative plate (6) by an upper pin (13) for rotation to each rotative plate;

a lower pin (16) fixed to each book rack (20) and extending through said circular gap (c) for each rotative plate (6), each lower pin being engaged in said circular groove (24) for riding in said circular groove with rotation of said rotating plate (1), the second center of rotation of said rotating plate being positioned above the first center for said circular groove (24) so that a line between said upper and lower pins for each book rack is always vertical as said rotating plate rotates the upper and lower pins (13, 16) being spaced by said vertical distance;

a plurality of rollers (7) rotatably mounted to each rotative plate (6) and rolling in a respective opening (2) of said rotating plate (1), said lower pin (16) being positioned between rollers of each rotative plate;

a motor (29) in said stand;

a pinion (30) connected to and rotated by said motor; and a ring gear (12) defined on said rotating plate (1) and meshed with said pinion (30) for rotation of said rotating plate when said pinion is rotated by activation of said motor.

2. An arrangement according to claim 1 including a plurality of rubber legs (41) connected to a rear side of said stable plate (21) which is opposite from said side of said plate in which said circular groove (24) is provided.

3. An arrangement according to claim 1 including a pair of actuating switches (31, 32) connected to said motor, one switch being activated for rotating said motor in one direction for counterclockwise rotation of said rotating plate and the other switch being activated for rotation of said motor in said opposite direction for clockwise rotation of said rotating plate.

* * * * *